US007347431B2

(12) United States Patent
Hill et al.

(10) Patent No.: US 7,347,431 B2
(45) Date of Patent: Mar. 25, 2008

(54) SKATEBOARD DECK CONSTRUCTION

(75) Inventors: Peter Hill, Port Melbourne (AU); Carlo Lunetta, Torrensville (AU); Scott Jensen, Huntington Beach, CA (US); Rodney Mullen, Redondo Beach, CA (US)

(73) Assignee: Chomp, Inc., El Segundo, CA (US)

( * ) Notice: Subject to any disclaimer, the term of this patent is extended or adjusted under 35 U.S.C. 154(b) by 0 days.

(21) Appl. No.: 11/220,278

(22) Filed: Sep. 6, 2005

(65) Prior Publication Data

US 2006/0049596 A1 Mar. 9, 2006

Related U.S. Application Data

(60) Provisional application No. 60/609,219, filed on Sep. 9, 2004, provisional application No. 60/612,003, filed on Sep. 10, 2004, provisional application No. 60/662,118, filed on Mar. 16, 2005.

(51) Int. Cl.
*B62M 1/00* (2006.01)

(52) U.S. Cl. ..... 280/87.042; 280/87.01; 280/87.021; 280/87.041

(58) Field of Classification Search ..... 280/87.042, 280/87.01, 87.021, 87.041, 610
See application file for complete search history.

(56) References Cited

U.S. PATENT DOCUMENTS

| | | | |
|---|---|---|---|
| 4,182,520 | A | 1/1980 | Stevenson |
| 4,295,656 | A | 10/1981 | Moore |
| 4,395,263 | A | 7/1983 | Davis |
| 4,806,412 | A | 2/1989 | Wank et al. |
| 4,810,551 | A | 3/1989 | Chu |
| 4,921,513 | A | 5/1990 | Parten |
| 5,271,996 | A | 12/1993 | Tanabe et al. |
| 5,591,509 | A | 1/1997 | Lorenz et al. |
| 5,716,562 | A | 2/1998 | Peart et al. |
| 5,759,664 | A | 6/1998 | Chisnell et al. |
| 5,769,445 | A | 6/1998 | Morrow |

(Continued)

FOREIGN PATENT DOCUMENTS

| | | |
|---|---|---|
| WO | WO 00/29080 | 5/2000 |

OTHER PUBLICATIONS

Vuckovich, "Skateboards Diversify," *Transworld Skateboarding*, Feb. 29, 2000.

(Continued)

*Primary Examiner*—Christopher P. Ellis
*Assistant Examiner*—Katy Meyer
(74) *Attorney, Agent, or Firm*—Knobbe, Martens, Olson & Bear, LLP

(57) ABSTRACT

According to one disclosed embodiment, a skateboard deck comprises a carbon-fiber shell surrounding a longitudinally-extending interior space. The carbon-fiber shell has an upper inner surface and a lower inner surface opposite the upper inner surface; and a longitudinal beam disposed within the interior space. The longitudinal beam has an upper flange bonded to the upper inner surface of the shell, a lower flange bonded to the lower inner surface of the shell, and a web interconnecting the upper flange and the lower flange. The skateboard deck further comprises a generally rigid exterior portion encasing the core member. The exterior portion comprises at least one layer of wood disposed above or below the shell.

32 Claims, 7 Drawing Sheets

U.S. PATENT DOCUMENTS

| | | | | |
|---|---|---|---|---|
| 5,863,050 | A | 1/1999 | Meader et al. | |
| 6,059,307 | A | 5/2000 | Western | |
| 6,182,986 | B1 | 2/2001 | Smith | |
| 6,386,561 | B1 | 5/2002 | Hanson | |
| 6,460,868 | B2 | 10/2002 | Madrid | |
| 6,527,284 | B2 | 3/2003 | Bert | |
| 6,648,363 | B2 * | 11/2003 | Gordon | 280/610 |
| 2002/0030338 | A1 * | 3/2002 | Bert | 280/87.041 |
| 2002/0185835 | A1 | 12/2002 | Wen | |
| 2003/0102650 | A1 | 6/2003 | Gordon | |
| 2003/0127831 | A1 * | 7/2003 | Wimbish et al. | 280/609 |
| 2003/0189314 | A1 | 10/2003 | Quattro et al. | |
| 2003/0222420 | A1 | 12/2003 | Hadzicki et al. | |
| 2004/0003886 | A1 | 1/2004 | Hunter | |
| 2004/0084878 | A1 | 5/2004 | Adamczewski | |
| 2004/0100052 | A1 | 5/2004 | Chou | |
| 2004/0135347 | A1 | 7/2004 | Marion | |
| 2004/0183269 | A1 * | 9/2004 | Hadzicki et al. | 280/87.042 |
| 2004/0188967 | A1 | 9/2004 | Gallo | |
| 2005/0134013 | A1 * | 6/2005 | Wright et al. | 280/87.042 |
| 2006/0097469 | A1 * | 5/2006 | Nosworthy et al. | 280/87.042 |

OTHER PUBLICATIONS

Haider, "Skateboard Science," *Transworld Skateboarding*, May 14, 2002.

Doughtery, "Time to bail?," *San Diego Union-Tribune*, Apr. 27, 2003.

Wegst et al., "Environmentally—Conscious Materials Selection and Design of Sports Equipment," Proceedings of the 3rd International Sports Engineering Association Conference on The Engineering of Sport, 2000.

"Skateboards Built One At A Time by Skateboarders," www.libskates.com, accessed Aug. 18, 2004.

* cited by examiner

SKATEBOARD DECK CONSTRUCTION

RELATED APPLICATIONS

This application claims the benefit under 35 U.S.C. § 119(e) of U.S. Provisional Application No. 60/609,219, filed Sep. 9, 2004, titled SKATEBOARD DECK CONSTRUCTION; and of U.S. Provisional Application No. 60/612,003, filed Sep. 10, 2004, titled SKATEBOARD DECK CONSTRUCTION; and of U.S. Provisional Application No. 60/662,118 filed Mar. 16, 2005, titled SKATEBOARD DECK CONSTRUCTION. The entire contents of each of the above-mentioned provisional patent applications are hereby incorporated by reference herein and made a part of this specification.

BACKGROUND OF THE INVENTION

1. Field of the Invention

Certain embodiments disclosed herein relate to skateboard deck construction.

2. Description of the Related Art

Skateboard decks constructed from laminated wood are well known. However, these and other known skateboard decks suffer from drawbacks in terms of strength, weight, durability, etc.

SUMMARY OF THE INVENTION

According to one embodiment, a skateboard deck comprises a core member comprising a hollow carbon fiber structure, and a generally rigid exterior portion encasing the core member. The exterior portion can optionally comprise a core surround which surrounds a perimeter edge of said core member, and an upper layer overlying said core member. The exterior portion can further optionally comprise a lower layer underlying the core member. The core member can optionally have a skateboard shape. The core member may further optionally comprise a reduced-size skateboard disposed within the exterior portion.

According to another embodiment, a method of making a skateboard deck comprises forming a core member from carbon fiber; imparting a skateboard shape to the core member; and after the imparting, building an exterior portion onto the skateboard-shaped core member. The core member can optionally be hollow. The exterior portion can optionally comprise a core surround and an upper layer. The exterior portion can further optionally comprise a lower layer.

According to another embodiment, a skateboard deck comprises a core member comprising a carbon fiber structure having an internal longitudinal beam, and a generally rigid exterior portion encasing the core member.

According to another embodiment, a core member for a skateboard deck comprises a carbon fiber shell surrounding a longitudinally-extending interior space, and a longitudinal beam disposed within the interior space. The longitudinal beam can optionally be bonded to at least one inner surface of the shell. The longitudinal beam can optionally define a first beam surface bonded to a first inner surface of the shell, and a second beam surface bonded to a second inner surface of the shell.

According to another embodiment, a skateboard deck comprises a carbon-fiber shell surrounding a longitudinally-extending interior space. The carbon-fiber shell has an upper inner surface and a lower inner surface opposite the upper inner surface; and a longitudinal beam disposed within the interior space. The longitudinal beam has an upper flange bonded to the upper inner surface of the shell, a lower flange bonded to the lower inner surface of the shell, and a web interconnecting the upper flange and the lower flange. The skateboard deck further comprises a generally rigid exterior portion encasing the core member. The exterior portion comprises at least one layer of wood disposed above or below the shell.

According to another embodiment, a core member for a skateboard deck comprises a carbon-fiber shell surrounding a longitudinally-extending interior space. The carbon-fiber shell has an upper inner surface and a lower inner surface opposite the upper inner surface. The core member further comprises a longitudinal beam disposed within the interior space. An upper portion of the longitudinal beam is bonded to the upper inner surface of the shell, a lower portion of the longitudinal beam is bonded to the lower inner surface of the shell. The longitudinal beam has a longitudinal cross section with an "S" configuration.

According to another embodiment, a skateboard deck comprises a carbon-fiber shell surrounding a longitudinally-extending interior space. The carbon-fiber shell has an upper inner surface and a lower inner surface opposite the upper inner surface, a longitudinal beam disposed within the interior space, and first and second truck blocks disposed within the interior space. The first and second truck blocks are located at first and second ends of the longitudinal beam. The skateboard deck further comprises a generally rigid exterior portion encasing the core member. The exterior portion comprises at least one layer of wood disposed above or below the shell.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the embodiments summarized above are intended to be within the scope of the invention herein disclosed. However, despite the foregoing discussion of certain embodiments, only the appended claims (and not the present summary) are intended to define the invention. The summarized embodiments, and other embodiments of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENT

Figure 1:
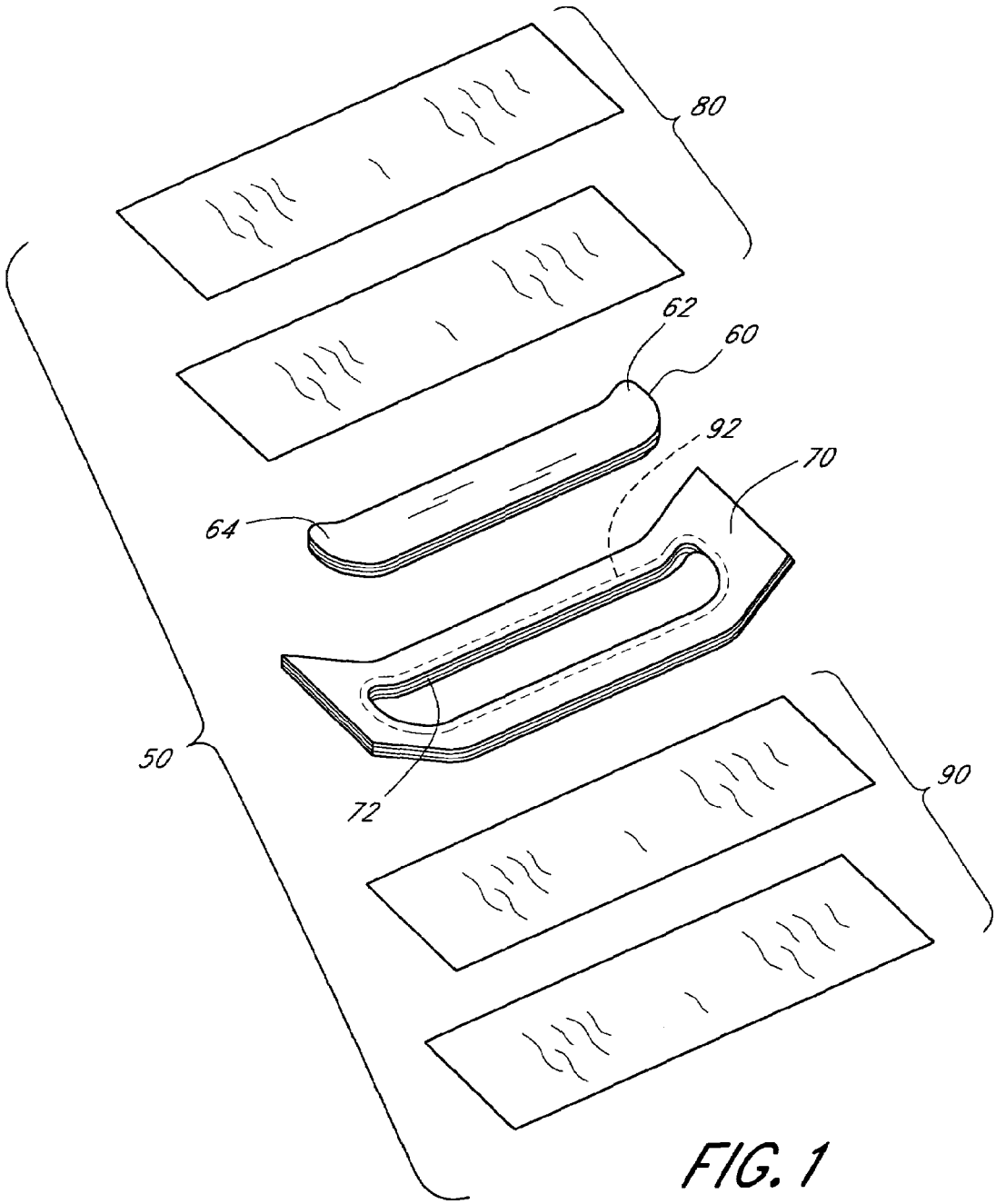
FIG. 1 is an exploded view of the construction of a skateboard deck.

FIG. 1 depicts one embodiment of a skateboard deck 50, which generally comprises a core member 60, a core surround 70 which surrounds the periphery of the core member 60, upper layers 80 which overlie the top of the core member 60 and core surround 70, and lower layers 90 which underlie the bottom of the core member 60 and core surround 70.

In the embodiment depicted in FIG. 1, the core member 60 may have a skateboard shape, i.e. it may comprise a miniature skateboard unto itself. Thus the core member 60 may have upturned front and rear ends 62, 64, a slightly concave upper surface, a slightly convex lower surface, and a platform having a shape approximating an elongated oval. In one embodiment, the core member may comprise a skateboard-shaped member or miniature skateboard deck formed from carbon fiber.

Figure 2:
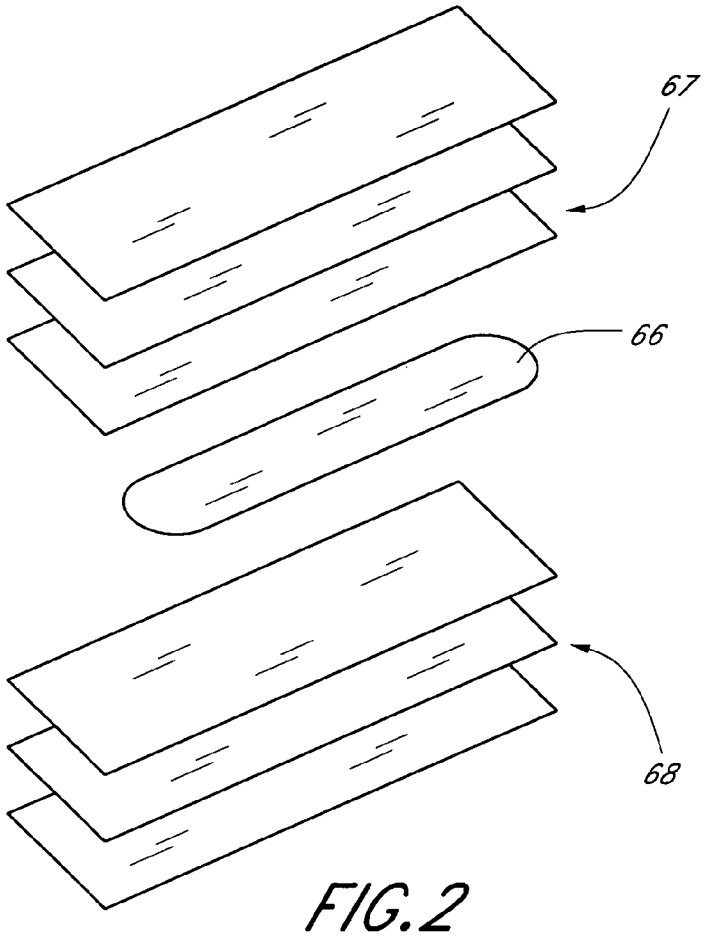
FIG. 2 is an exploded view of the construction of a core member of the skateboard deck of FIG. 1.

The core member 60 may be further configured as shown in FIG. 2, with a foam (e.g., polyester foam) center layer 66 and upper and lower carbon fiber layers 67, 68 which wrap around the center layer 66. The core member 66 may be constructed by wrapping the carbon fiber layers 67, 68 around the center layer 66, with resin and/or other adhesives between the carbon fiber layers 67, 68 (and/or between the carbon fiber layers 67, 68 and the center layer 66), so that the "wrapped" assembly takes on the approximate, elongated-oval platform of the center layer 66. After wrapping, the core member 66 is pressed into the "skateboard" shape described above and depicted in FIG. 1.

Thus, in the embodiment depicted in FIG. 1, the core member 60 comprises a hollow, enclosed multi-layer carbon fiber member with a "skateboard" shape. (The core member 60 is "hollow" in that its center is an empty space or is occupied by a material other than carbon fiber, or by a material which is less dense than carbon fiber.) The core member 60 thus achieves great strength and light weight with a minimum of carbon fiber material, as compared to a simple single layer or layered "sandwich" of multiple carbon fiber layers.

In one embodiment, the carbon fiber layers 67, 68 may comprise three upper and three lower layers, and each of the six layers may be 0.5 mm thick. The resulting core member 60 has a thickness of 0.185 inches.

Figure 3:
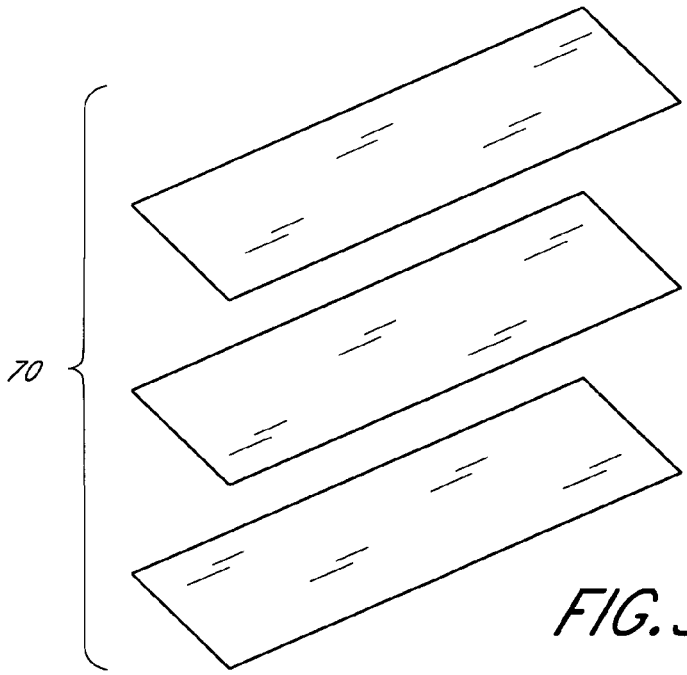
FIG. 3 is an exploded view of the construction of a core surround of the skateboard deck of FIG. 1.

FIG. 3 depicts the construction of the core surround 70 in greater detail. A number (e.g., 3, as depicted) of sheets of wood, fiberglass, plastic, etc. are glued and pressed together to form an enlarged (as compared to the core member 66) skateboard shape within the perimeter of the core surround 70. From within this enlarged skateboard shape is cut out a smaller skateboard shape approximating the size of the core member 66. Thus is formed an inner edge 72 of the core surround 70, which inner edge 72 closely abuts the outer edge of the core member 66 when the core member 66 is placed inside the core surround 70. The core surround 70 thus extends outward from the perimeter of the core member 60, in the completed deck 50.

Upon placement of the core member 60 inside the core surround 70, the upper and lower layers 80, 90 are pressed and bonded together with the core-member-core-surround assembly disposed between them, so that the upper and lower layers 80, 90 conform closely to the contoured shape defined by the core-member-core-surround assembly. The resulting structure is then permitted to cure for an appropriate length of time, and the upper and lower layers 80, 90 and core surround 70 are cut to create a skateboard platform for the overall deck 50. One example of a cut pattern is shown with the dashed lines 92. Any suitable molding and/or lamination processes may be used to join the core member 60, core surround 70 and upper and lower layers 80, 90.

After cutting, the completed deck 50 comprises the core member 66, encased by the core surround 70 and the upper and lower layers 80, 90. Thus the deck 50 comprises a "skateboard within a skateboard" (the skateboard-shaped core member 66 disposed within the layers 80, 90 and the core surround 70). Trucks, wheels, rails, etc. may be added to the deck 50 to create a complete skateboard.

In one embodiment, the core surround 70 may comprise three layers of North American hard maple wood, of 0.062 inches thickness each, to create a core surround 70 of 0.0185 inches thick. In this embodiment the upper and lower layers 80, 90 may also be formed from North American hard maple wood, with the uppermost upper layer 80 and the lowermost lower layer 90 0.062 inches thick, and the balance of the layers 80, 90 0.042 inches thick. The overall thickness of the deck 50 may be about 0.393 inches.

FIGS. 4-7 depict another embodiment of a core member 160, which can be generally similar to the core member 60, except as further described below. As with the core member 60 described above, the core member 160 of FIGS. 4-7 generally comprises a foam center layer 166 surrounded and enclosed by a carbon fiber shell 110. In one embodiment the shell 110 may be formed by wrapping a number of upper and lower layers of carbon fiber material around the center layer 166 and pressing and bonding together the resulting structure, e.g. as shown and described above with regard to the core member 60.

Figure 6:
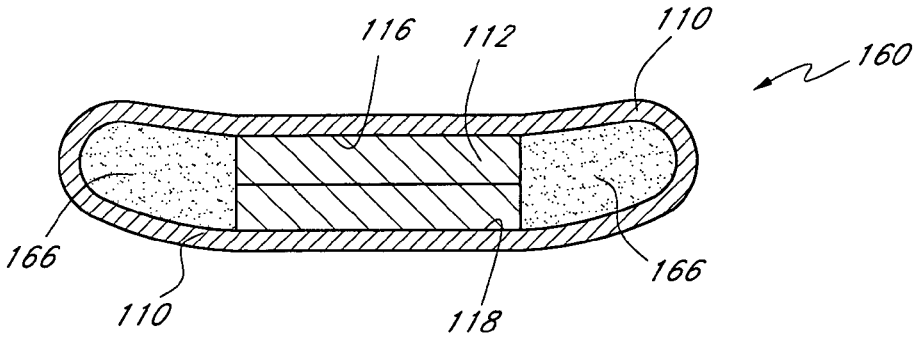
FIG. 6 is a cross sectional view of the core member of FIG. 4, taken along the line 6-6 in FIG. 5.

In the depicted embodiment the core member 160 also includes a pair of hardpoints or truck blocks 112 which reside within the shell 110 and are situated in suitable spaces or openings formed in the center layer 166. The truck blocks are positioned on the longitudinal centerline of the core member 160, and are preferably formed from a rigid and resilient material (e.g. wood, heavy plastic, fiber-reinforced plastic) to receive screws (not shown) that are driven into the deck 50 to hold a pair of trucks to the deck. To accommodate assembly of the center layer 166 around the truck blocks 112, the material of the center layer may be divided into halves by a longitudinal seam 114. As best seen in FIG. 6, in one embodiment the truck blocks may each comprise two stacked layers of wood. Preferably, each of the truck blocks extend from an inner upper surface 116 of the shell 110 to an inner lower surface 118 thereof, so that the blocks abut the shell material at each of the surfaces 116, 118.

Figure 4:
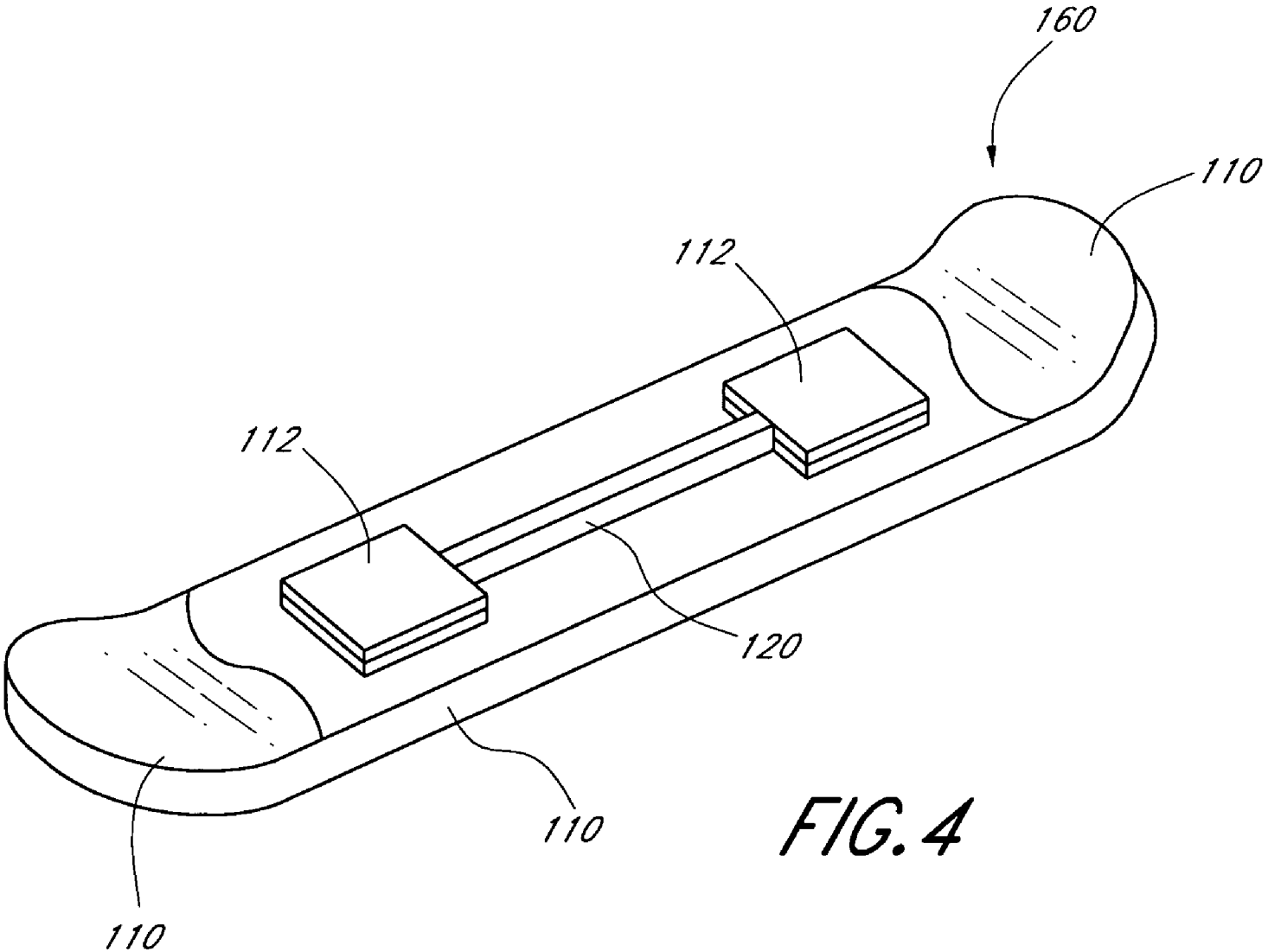
FIG. 4 is a perspective view of another embodiment of a core member suitable for use in the skateboard deck of FIG. 1, with an upper portion of a shell of the core member partially cut away and a center layer of the core member removed for clarity.
Figure 5:
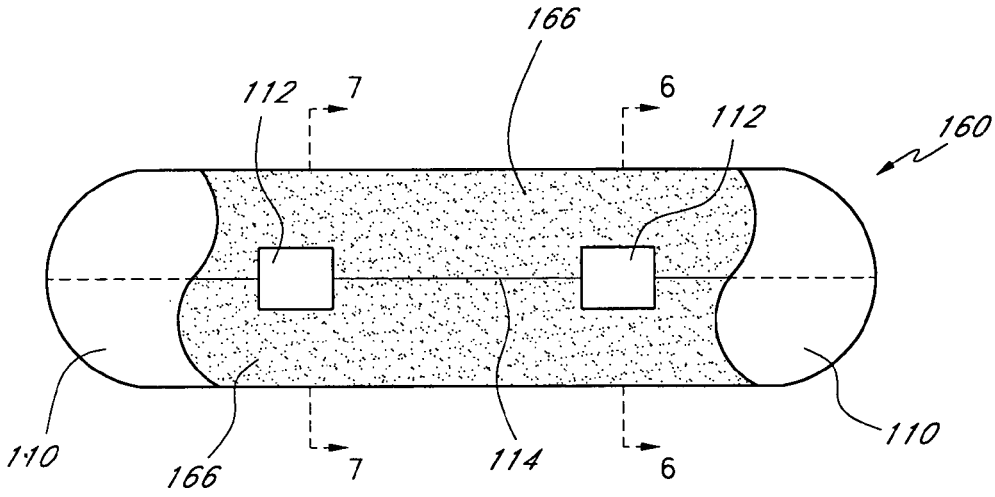
FIG. 5 is a top view of the core member of FIG. 4, with the upper portion of the shell partially cut away for clarity.
Figure 7:
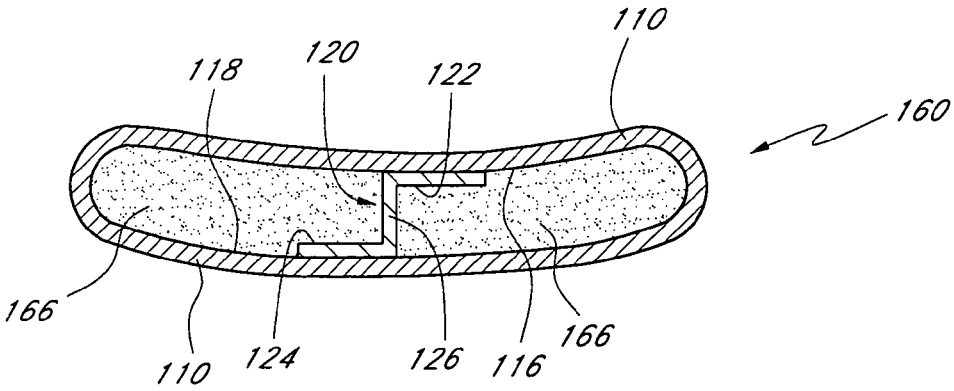
FIG. 7 is a cross sectional view of the core member of FIG. 4, taken along the line 7-7 in FIG. 5.
Figure 8:
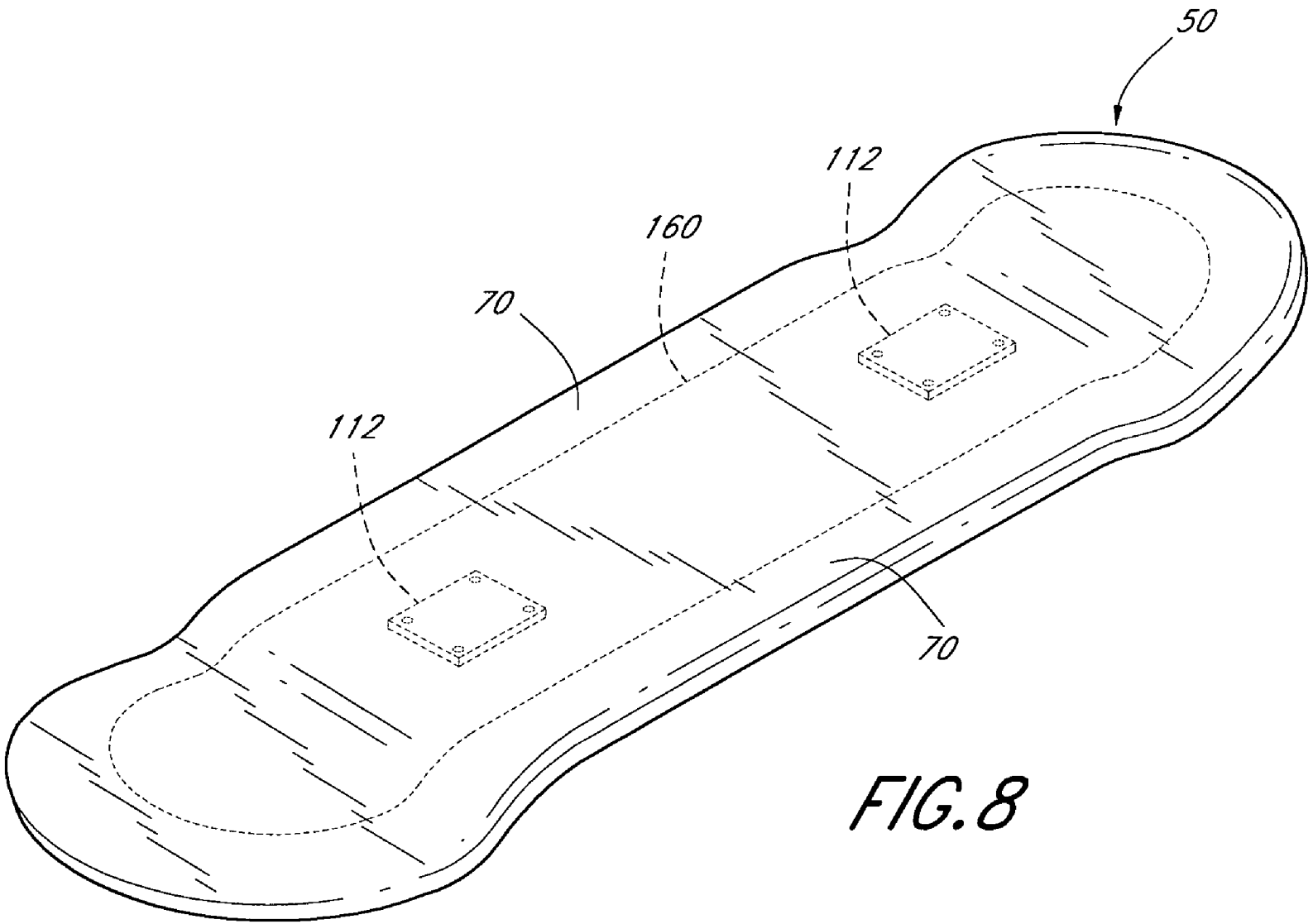
FIG. 8 is a perspective view of a skateboard deck incorporating a version of the core member of FIGS. 4-7.
Figure 9:
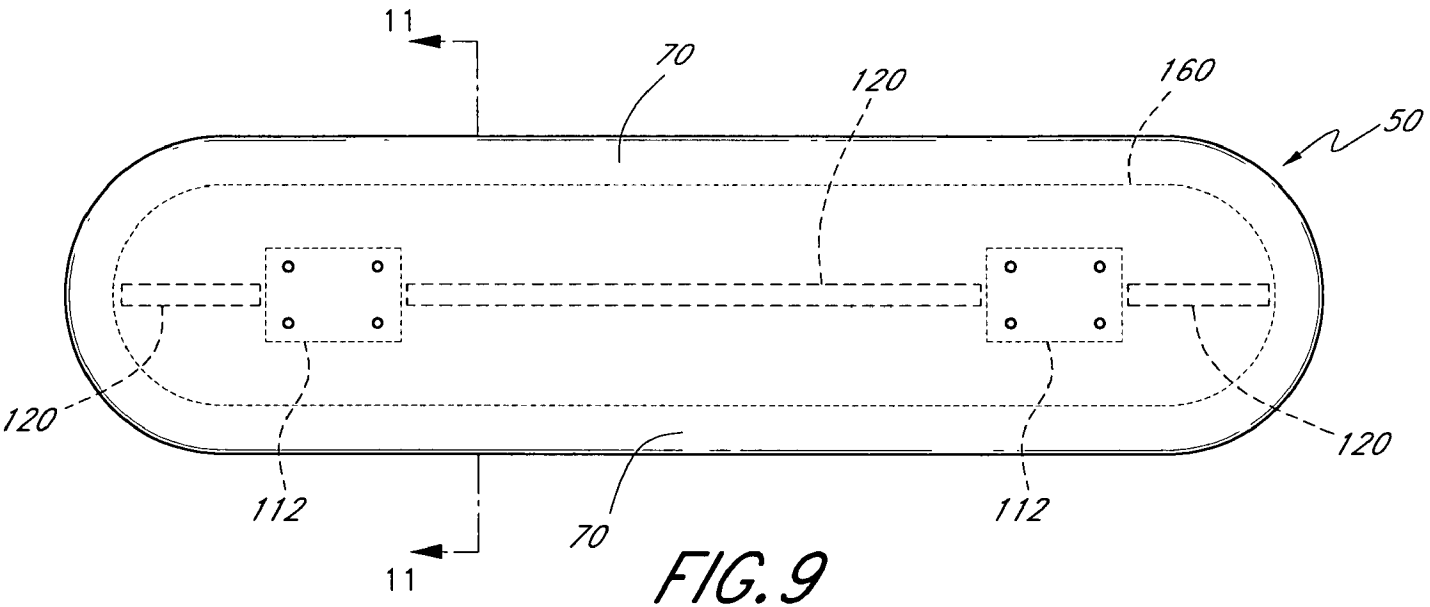
FIG. 9 is a top view of the skateboard deck of FIG. 8.
Figure 10:
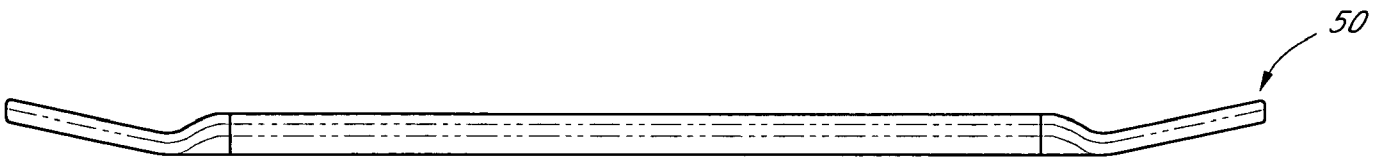
FIG. 10 is a side view of the skateboard deck of FIG. 8.

As best seen in FIGS. 4 and 7, in one embodiment the core member 160 may further comprise a longitudinal beam 120 that extends generally along the longitudinal centerline of the member 160, from one of the truck blocks 112 to the other. (In another embodiment, the longitudinal beam 120 can further extend longitudinally from each truck block 112 to the adjacent end of the core member 160 (see FIG. 9).) The depicted longitudinal beam 120 has an "S" cross section along its entire length, thereby forming upper and lower flanges 122, 124 interconnected by a web 126. In other embodiments, the beam 120 may have a different cross section, such as an "I," "T," "U," etc., or a box section.

During construction of the core member 160 the upper flange 122 may be securely bonded to the inner upper surface 116 of the shell 110, and the lower flange 124 securely bonded to the inner lower surface 118, to impart great strength and rigidity to the core member.

In one embodiment, the core member 160 may have the following dimensions: overall length of 740 mm; overall width of 140 mm; overall thickness of 4 mm; truck block length of 90 mm; truck block width of 70 mm; and center layer thickness of 3 mm. In this embodiment, the longitudinal distance between the truck blocks is preferably 320 mm.

Further details of the construction of one embodiment of the deck 50 and core member 160 may be seen in FIGS. 8-11B. (The deck 50 and core member 160 of FIGS. 8-11B can be similar to the deck 50 and core members 60, 160 depicted in FIGS. 1-7, except as further described below.) In this embodiment, the center layer 166 of the core member 160 is situated between upper layers 167*a*, 167*b*, 167*c* and lower layers 168*a*, 168*b*, 168*c* (see FIG. 11A). The upper layers 167*a*, 167*b* and the lower layers 168*a*, 168*b* preferably comprise carbon fiber material, and more preferably comprise layers of VTM246 200 gsm unidirectional "prepreg" carbon fiber fabric, trimmed to the profile of the center layer 166 with 10 mm overlap on the edges. The innermost upper layer 167*c* and lower layer 168*c* preferably also comprise carbon fiber material, and more preferably comprise layers of MTM56 200 gsm 2/2 twill prepreg carbon fiber fabric, trimmed to the profile of the center layer 166 with 10 mm overlap on the edges. In addition, the center layer 166 preferably comprises 3 mm thick polyester foam with a density of 80 kg per cubic meter.

Figure 11B:
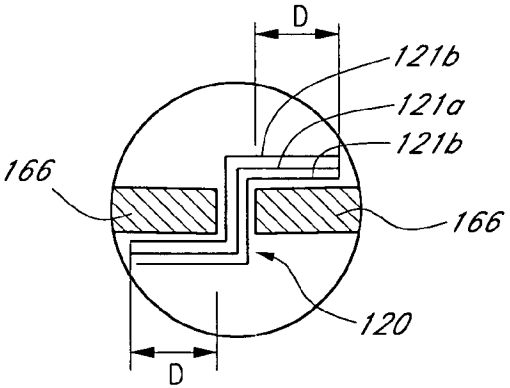
FIG. 11B is a schematic detail view of the indicated portion of FIG. 11, showing the construction of the longitudinal beam and its position in the center layer of the core member.

In the embodiment of FIGS. 8-11B, the longitudinal beam 120 can have a 3-layer configuration as shown in FIG. 11B, with an inner layer 121*a* situated between two outer layers 121*b*. The inner layer 121*a* preferably comprises carbon fiber material, and more preferably comprises a layer of MTM56 200 gsm 2/2 twill prepreg carbon fiber fabric, trimmed to a width of 40 mm. The outer layers 121*b* preferably comprise carbon fiber material, and more preferably comprise layers of VTM246 200 gsm unidirectional prepreg carbon fiber fabric, trimmed to a width of 40 mm.

Figure 11A:
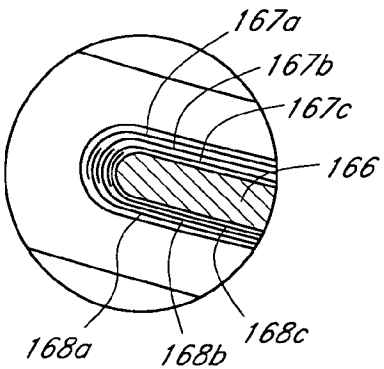
FIG. 11A is a detail view of the indicated portion of FIG. 11.
Figure 11:
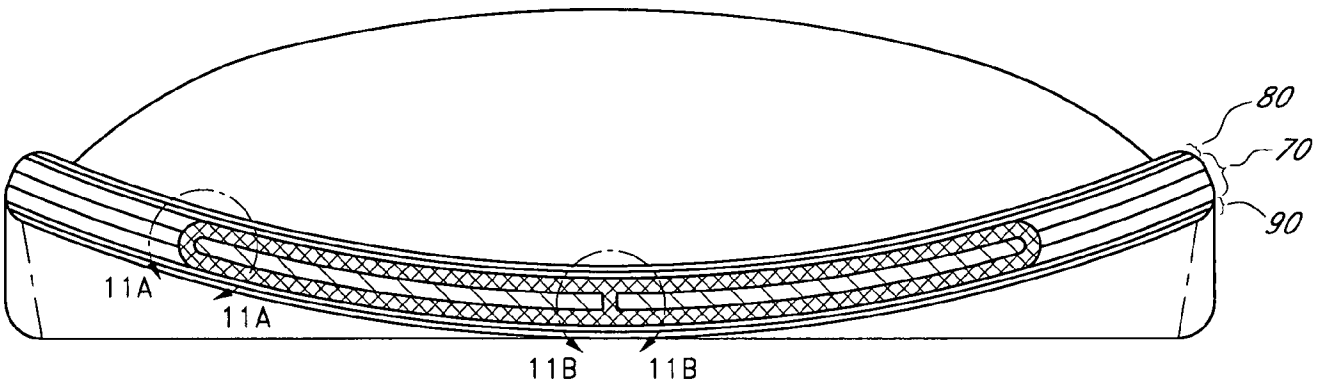
FIG. 11 is a sectional view of the skateboard deck of FIG. 8, taken along the line 11-11 in FIG. 9.

The core member 160 can be constructed by a lay-up process. This process preferably comprises: (a) preparing the truck blocks or hardpoints 112 with appropriately sized (e.g., 90 mm×70 mm) plywood blocks wrapped in adhesive film (e.g., MTM26 resin adhesive film); (b) cutting openings in the material of the center layer 166 to accommodate the truck blocks 112; (c) positioning the longitudinal rib 120 between the two halves of the center layer 166 as shown in FIG. 11B (preferably overlapping the upper and lower faces of the center layer 166 by a distance D of 15 mm); (d) inserting the prepared truck blocks into the openings in the center layer 166; (e) applying the innermost lower layer 168*c* with overlap as shown in FIG. 11A; (f) applying the innermost upper layer 167*c* with overlap over the innermost lower layer 168*c* as shown in FIG. 11A; (g) applying the next lower layer 168*b* with overlap over the underlying layers 167*c*, 168*c* as shown in FIG. 11A; (h) applying the next upper layer 167*b* with the depicted overlap; (i) applying the next lower layer 168*a* with the depicted overlap; and (j) applying the next upper layer 167*a* with the depicted overlap.

After layup, the core member 160 can be placed in a matched-pair mold under vacuum (preferably 1 ATM) and cured at a temperature of 120 C for 15 minutes. After molding and curing, the core member 160 is permitted to cool and is trimmed as necessary for attachment of the upper and lower layers 80, 90 and the core surround 70. The core member 160 may be sanded or otherwise roughened to eliminate any "glossy" spots and improve the adhesion of the core member 160 to the upper and lower layers 80, 90.

Once the completed core member 160 is ready, the upper and lower layers 80, 90 and the core surround 70 can be built onto the core member as discussed above with reference to FIG. 1, to create a complete skateboard deck 50.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular embodiments described above, but should be determined only by a fair reading of the claims that follow.

What is claimed is:

1. A skateboard deck comprising:

a carbon-fiber shell surrounding a longitudinally-extending interior space, said carbon-fiber shell having an upper inner surface and a lower inner surface opposite said upper inner surface;

a longitudinal beam disposed within said interior space; said longitudinal beam having:

an upper flange connected to said upper inner surface of said shell;

a lower flange connected to said lower inner surface of said shell; and a web interconnecting said upper flange and said lower flange; and a generally rigid exterior portion encasing said carbon-fiber shell, said exterior portion comprising at least one layer of wood disposed above or below said shell.

2. The deck of claim 1, wherein said longitudinal beam has a longitudinal cross section with an "S" configuration.

3. The deck of claim 1, wherein said longitudinal beam is formed from carbon-fiber material.

4. The deck of claim 1, further comprising foam material disposed within said shell.

5. The deck of claim 4, wherein said foam material abuts either side of said web.

6. The deck of claim 1, further comprising first and second truck blocks disposed within said shell.

7. The deck of claim 6, wherein said first and second truck blocks abut first and second ends of said longitudinal beam.

8. The deck of claim 1, wherein said at least one layer of wood comprises a first layer of wood disposed above said shell and a second layer of wood disposed below said shell.

9. The deck of claim 1, wherein the longitudinal beam is formed separately from the shell.

10. The deck of claim 9, wherein the upper flange is bonded to the upper inner surface of the shell, and the lower flange is bonded to the lower inner surface of the shell.

11. A core member for a skateboard deck, said core member comprising:

a carbon-fiber shell surrounding a longitudinally-extending interior space, said carbon-fiber shell having an upper inner surface and a lower inner surface opposite said upper inner surface; and a longitudinal beam disposed within said interior space, an upper portion of said longitudinal beam bonded to said upper inner surface of said shell, a lower portion of said longitudinal beam bonded to said lower inner surface of said shell, said longitudinal beam having a longitudinal cross section with an "S" configuration.

12. The core member of claim 11, wherein said longitudinal beam comprises:

an upper flange bonded to said upper inner surface of said shell;

a lower flange bonded to said lower inner surface of said shell; and a web interconnecting said upper flange and said lower flange.

13. The core member of claim 11, wherein said longitudinal beam is formed from carbon-fiber material.

14. The core member of claim 11, further comprising foam material disposed within said shell.

15. The core member of claim 14, wherein said foam material abuts either side of said web.

16. The core member of claim 11, further comprising first and second truck blocks disposed within said shell.

17. The core member of claim 16, wherein said first and second truck blocks abut first and second ends of said longitudinal beam.

18. A skateboard deck comprising:

a carbon-fiber shell surrounding a longitudinally-extending interior space, said carbon-fiber shell having an upper inner surface and a lower inner surface opposite said upper inner surface, a foam material being disposed within said shell;

a longitudinal beam disposed within said interior space;

first and second truck blocks disposed within said interior space, said first and second truck blocks being located at first and second ends of said longitudinal beam and being adapted to extend between and engage the upper inner surface and the lower inner surface of the shell; and a generally rigid exterior portion encasing said shell, said exterior portion comprising at least one layer of wood disposed above or below said shell.

19. The deck of claim 18, wherein said longitudinal beam comprises a web, and foam material abuts either side of said web.

20. The deck of claim 19, wherein said longitudinal beam has a longitudinal cross section with an "S" configuration.

21. The deck of claim 19, wherein said longitudinal beam is formed from carbon-fiber material.

22. The deck of claim 18, wherein said at least one layer of wood comprises a first layer of wood disposed above said shell and a second layer of wood disposed below said shell.

23. The deck of claim 18, wherein said first and second truck blocks abut said first and second ends of said longitudinal beam.

24. A skateboard deck comprising:

a carbon-fiber shell surrounding a longitudinally-extending interior space, said carbon-fiber shell having an upper inner surface and a lower inner surface opposite said upper inner surface;

a longitudinal beam disposed within said interior space;

first and second truck blocks disposed within said interior space, said first and second truck blocks being located at first and second ends of said longitudinal beam and being adapted to extend between and engage the upper inner surface and the lower inner surface of the shell, said first and second truck blocks abutting said first and second ends of said longitudinal beam; and a generally rigid exterior portion encasing said shell, said exterior portion comprising at least one layer of wood disposed above or below said shell.

25. The deck of claim 24, wherein said longitudinal beam comprises a web, and foam material abuts either side of said web.

26. A skateboard deck comprising:

a carbon-fiber shell surrounding a longitudinally-extending interior space, said carbon-fiber shell having an upper inner surface and a lower inner surface opposite said upper inner surface;

a longitudinal beam disposed within said interior space, the longitudinal beam having a longitudinal cross section with an "S" configuration;

first and second truck blocks disposed within said interior space, said first and second truck blocks being located at first and second ends of said longitudinal beam; and a generally rigid exterior portion encasing said shell, said exterior portion comprising at least one layer of wood disposed above or below said shell.

27. The deck of claim 26, wherein the longitudinal beam is formed separately from the shell.

28. A skateboard deck comprising:

a fiber-reinforced composite shell surrounding a longitudinally-extending interior space, said composite shell having an upper inner surface and a lower inner surface opposite said upper inner surface;

a longitudinal beam disposed within said interior space;

first and second truck blocks disposed within said interior space, said first and second truck blocks being located at first and second ends of said longitudinal beam, and first and second truck blocks abut said first and second ends of said longitudinal beam; and a generally rigid exterior portion encasing said composite shell, said exterior portion comprising a first layer of wood disposed above said shell and a second layer of wood disposed below said shell.

29. The deck of claim 28, wherein said longitudinal beam is formed separately from the composite shell.

30. The deck of claim 29, wherein said longitudinal beam has a longitudinal cross section with an "S" configuration.

31. The deck of claim 28, wherein the first and second truck blocks engage both the upper interior surface and the lower interior surface.

32. The deck of claim 28, wherein the composite shell comprises carbon fiber.

* * * * *